US011506137B2

(12) United States Patent
Miyazaki et al.

(10) Patent No.: US 11,506,137 B2
(45) Date of Patent: Nov. 22, 2022

(54) CONTROLLER AND CONTROL METHOD FOR INTERNAL COMBUSTION ENGINE

(71) Applicant: TOYOTA JIDOSHA KABUSHIKI KAISHA, Toyota (JP)

(72) Inventors: Takashi Miyazaki, Toyota (JP); Yasuyuki Takaki, Toyota (JP); Takahiro Anami, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 20 days.

(21) Appl. No.: 16/779,755

(22) Filed: Feb. 3, 2020

(65) Prior Publication Data

US 2020/0277910 A1 Sep. 3, 2020

(30) Foreign Application Priority Data

Feb. 28, 2019 (JP) ..... JP2019-035950

(51) Int. Cl.
*F02D 41/14* (2006.01)
*F01N 11/00* (2006.01)

(52) U.S. Cl.
CPC ..... *F02D 41/145* (2013.01); *F01N 11/005* (2013.01); *F02D 2200/023* (2013.01); *F02D 2200/024* (2013.01); *F02D 2200/04* (2013.01); *F02D 2200/0812* (2013.01)

(58) Field of Classification Search
CPC ..... F01N 11/005; F01N 2560/08; F01N 2900/08; F01N 2900/1406; F01N 9/005; F02D 2200/023; F02D 2200/024; F02D 2200/04; F02D 2200/0812; F02D 2250/34; F02D 41/0002; F02D 41/08; F02D 41/1448; F02D 41/145; F02D 41/18
See application file for complete search history.

(56) References Cited

U.S. PATENT DOCUMENTS

2005/0268597 A1* 12/2005 Kosaka ..... F01N 9/005 60/277
2006/0169136 A1* 8/2006 Avery, Jr. ..... F02D 41/2441 95/19
2007/0180818 A1* 8/2007 Matsuoka ..... F01N 13/009 60/286
2007/0251214 A1* 11/2007 Nishino ..... F02D 41/1448 60/277
2010/0018186 A1* 1/2010 Shibata ..... F01N 9/007 60/277

(Continued)

FOREIGN PATENT DOCUMENTS

JP 11 -280449 A 10/1999

*Primary Examiner* — Phutthiwat Wongwian
*Assistant Examiner* — Diem T Tran
(74) *Attorney, Agent, or Firm* — Oblon, McClelland, Maier & Neustadt, L.L.P.

(57) ABSTRACT

A controller is configured to perform a process of obtaining an exhaust pressure upstream of a filter inside an exhaust passage and an intake air amount detected by an air flowmeter, when the filter in which a deposition amount of particulate matter is a specified amount is referred to as a reference filter, a calculation process of calculating an exhaust pressure rate that indicates a ratio of the obtained exhaust pressure to an exhaust pressure at the reference filter for the obtained intake air amount, and a setting process of setting the exhaust pressure rate that is maintained at a specific value during engine operation.

7 Claims, 7 Drawing Sheets

(56) References Cited

U.S. PATENT DOCUMENTS

| | | | | |
|---|---|---|---|---|
| 2010/0111790 | A1* | 5/2010 | Kammel | F01N 3/027<br>422/112 |
| 2015/0315950 | A1* | 11/2015 | Hagimoto | F01N 13/0097<br>73/114.75 |
| 2016/0097310 | A1* | 4/2016 | Yamashita | F01N 3/106<br>96/421 |
| 2017/0211451 | A1* | 7/2017 | Imai | B01D 46/0061 |

* cited by examiner

CONTROLLER AND CONTROL METHOD FOR INTERNAL COMBUSTION ENGINE

BACKGROUND

1. Field

The following description relates to a controller and a control method for an internal combustion engine.

2. Description of Related Art

Japanese Laid-Open Patent Publication No. 11-280449 describes an example of an internal combustion engine including a filter that collects particulate matter from exhaust gas and a pressure sensor that detects an exhaust pressure upstream of the filter. In the internal combustion engine, the exhaust pressure detected by the pressure sensor increases as an intake air amount drawn into the cylinders increases or the amount of particulate matter deposited in the filter increases and the degree of clogging increases even if the intake air amount is the same.

The internal combustion engine performs various types of engine control based on the exhaust pressure such as adjustment of the opening degree of the EGR valve and calculation of the intake air amount using an air model.

During engine operation, the exhaust pressure fluctuates and exhibits unstable values. Thus, engine control based on the exhaust pressure is unstable. It is desirable that values that show the state of the exhaust pressure during engine operation be as stable as possible while indicating an actual state of the exhaust pressure.

SUMMARY

It is an objective of the present disclosure to provide a controller and a control method for an internal combustion engine that stabilize values showing the state of an exhaust pressure during engine operation.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a first embodiment of the present disclosure provides a controller for an internal combustion engine. The internal combustion engine includes a filter that is arranged in an exhaust passage and collects particulate matter from exhaust gas, and an intake flow rate sensor that detects an intake air amount drawn into a cylinder. The filter in which a deposition amount of particulate matter is a specified amount is referred to as a reference filter. The controller is configured to perform a process of obtaining an exhaust pressure upstream of the filter inside the exhaust passage and the intake air amount detected by the intake flow rate sensor, a calculation process of calculating an exhaust pressure rate that indicates a ratio of the obtained exhaust pressure to an exhaust pressure at the reference filter for the obtained intake air amount, and a setting process of setting the exhaust pressure rate that is maintained at a specific value during engine operation.

In another general aspect, a second embodiment of the present disclosure provides a controller for an internal combustion engine. The internal combustion engine includes a filter that is arranged in an exhaust passage and collects particulate matter from exhaust gas, and an intake flow rate sensor that detects an intake air amount drawn into a cylinder. The filter in which a deposition amount of particulate matter is a specified amount is referred to as a reference filter. The controller includes a circuit that is configured to perform a process of obtaining an exhaust pressure upstream of the filter inside the exhaust passage and the intake air amount detected by the intake flow rate sensor, a calculation process of calculating an exhaust pressure rate that indicates a ratio of the obtained exhaust pressure to an exhaust pressure at the reference filter for the obtained intake air amount, and a setting process of setting the exhaust pressure rate that is maintained at a specific value during engine operation.

In another general aspect, a third embodiment of the present disclosure provides a control method for an internal combustion engine. The internal combustion engine includes a filter that is arranged in an exhaust passage and collects particulate matter from exhaust gas, and an intake flow rate sensor that detects an intake air amount drawn into a cylinder. The filter in which a deposition amount of particulate matter is a specified amount is referred to as a reference filter. The control method includes obtaining an exhaust pressure upstream of the filter inside the exhaust passage and the intake air amount detected by the intake flow rate sensor, calculating an exhaust pressure rate that indicates a ratio of the obtained exhaust pressure to an exhaust pressure at the reference filter for the obtained intake air amount, and setting the exhaust pressure rate that is maintained at a specific value during engine operation.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described.

Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A controller 100 for an internal combustion engine 10 according to a first embodiment will now be described with reference to FIGS. 1 to 6.

Figure 1:
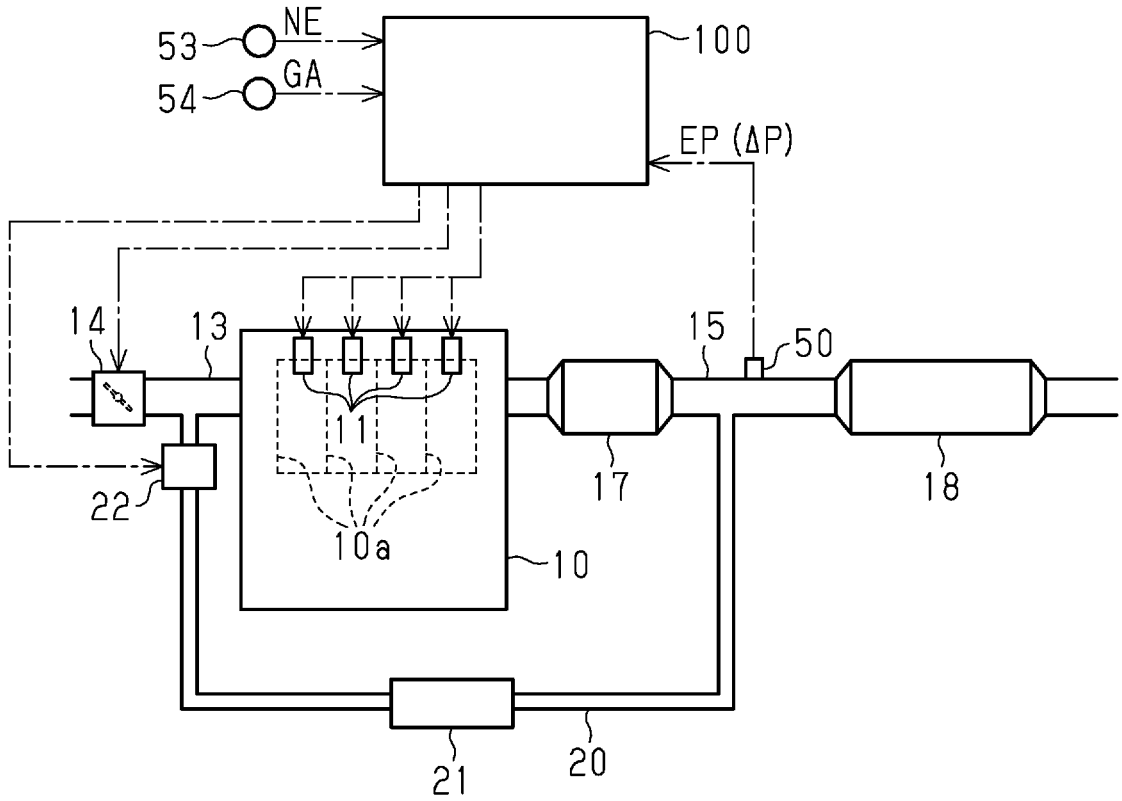
FIG. 1 is a schematic diagram of an internal combustion engine employing a controller according to a first embodiment of the present disclosure.

As shown in FIG. 1, the internal combustion engine 10 includes cylinders 10*a*. The intake port for the cylinders 10*a* is connected to an intake passage 13. The intake passage 13 includes a throttle valve 14 that adjusts an intake air amount.

The combustion chambers of the cylinders 10*a* each include a fuel injection valve 11. In the combustion chamber, air drawn in through the intake passage 13 is mixed with fuel injected by the fuel injection valve 11 and becomes an air-fuel mixture. The air-fuel mixture is ignited by spark discharge and burned in the combustion chamber. Exhaust gas generated when the air-fuel mixture is burned is discharged from the exhaust port of the internal combustion engine 10 into an exhaust passage 15.

The exhaust passage 15 is connected to a three-way catalyst 17. The three-way catalyst 17 oxidizes hydrocarbon (HC) and carbon monoxide (CO) contained in the exhaust gas and generates water and carbon dioxide. The three-way catalyst 17 reduces nitrogen oxides (NOx) contained in the exhaust gas and generates nitrogen.

The exhaust passage 15, which is downstream of the three-way catalyst 17, includes a filter 18 that collects particulate matter (PM) in exhaust gas. The internal combustion engine 10 includes an exhaust gas recirculation device that returns some of exhaust gas to the intake passage 13. The exhaust gas recirculation device includes an EGR passage 20, an EGR cooler 21, and an EGR valve 22.

The EGR passage 20 connects the exhaust passage 15 to the intake passage 13. The EGR passage 20 connects the exhaust passage 15, which is arranged between the three-way catalyst 17 and the filter 18, to the intake passage 13, which is downstream of the throttle valve 14.

The EGR valve 22 is arranged in the EGR passage 20. When the EGR valve 22 is open, exhaust gas (EGR gas) flows into the EGR passage 20. The EGR cooler 21 of a water-cooling type is arranged in the EGR passage 20 between the EGR valve 22 and the exhaust passage 15. Heat is exchanged between the EGR cooler 21 and an engine coolant.

The internal combustion engine 10 includes the controller 100 that has a central processing unit (CPU), a memory, and the like. The controller 100 performs various types of control and various types of process for the internal combustion engine 10 by causing the CPU to execute programs stored in the memory.

Detection signals from various types of sensors are input to the controller 100. A pressure sensor 50 is arranged in, for example, the exhaust passage 15 between the three-way catalyst 17 and the filter 18. The pressure sensor 50 detects exhaust pressure EP (absolute pressure) that is upstream of the filter 18. The pressure sensor 50 also detects differential pressure AP that indicates the difference between exhaust pressure EP and an atmospheric pressure. Differential pressure AP is used as a value indicating the pressure difference in the exhaust passage 15 between the exhaust pressure upstream of the filter 18 and the exhaust pressure downstream of the filter 18. The internal combustion engine 10 includes a crank angle sensor 53 near the crankshaft. The crank angle sensor 53 detects engine speed NE of the internal combustion engine 10. An air flowmeter 54, which serves an intake flow rate sensor, is arranged upstream of the intake passage 13. The air flowmeter 54 detects intake air amount GA drawn into the cylinders 10*a*.

The controller 100 calculates exhaust temperature THE, which is the temperature of exhaust gas flowing into the filter 18, and filter temperature TF, which is an estimated temperature of the filter 18, based on various types of engine operation states such as intake air amount GA and engine speed NE. The engine controller 100 also calculates PM deposition amount Ps, which is a deposition amount of particulate matter of the filter 18, based on engine speed NE, engine load factor KL, filter temperature TF, and the like.

When PM deposition amount Ps is greater than or equal to preset regeneration threshold a, the controller 100 performs regeneration control on the filter 18 to burn and remove PM deposited in the filter 18 so as to regenerate the filter 18. The regeneration control includes a temperature increase control that heats the filter 18 and a PM combustion control that burns and removes PM. PM is burned and removed when the atmosphere inside the filter 18, which is heated by the temperature increase control, becomes an oxidizing atmosphere.

In the first embodiment, the temperature increase control performs dither control so that some of the cylinders 10*a* of the internal combustion engine 10 serve as rich combustion cylinders and the other cylinders 10*a* serve as lean combustion cylinders. The rich combustion cylinders have an air-fuel ratio richer than the stoichiometric air-fuel ratio. The lean combustion cylinders have an air-fuel ratio leaner than the stoichiometric air-fuel ratio. When the dither control is performed, unburned fuel components and incomplete combustion components in exhaust gas, which is discharged by the rich combustion cylinders, react with oxygen in exhaust gas, which is discharged by the lean combustion cylinders. The reaction is accelerated by the three-way catalyst 17 and the three-way catalyst 17 is heated. The heated three-way catalyst 17 raises the temperature of exhaust gas passing through the three-way catalyst 17. When exhaust gas with a high temperature flows into the filter 18 downstream of three-way catalyst 17, the filter 18 has a high temperature. The PM combustion control by which the atmosphere inside the filter 18, which has a high temperature, becomes an oxidizing atmosphere, performs a fuel cutoff process that stops fuel injection of the fuel injection valves 11 during engine operation and a lean combustion process that sets a value leaner than the stoichiometric air-fuel ratio to a target air-fuel ratio for an air-fuel mixture. This provides oxygen to the exhaust passage 15 so that PM collected in the filter 18 is burned (oxidized) and removed.

The controller 100 calculates target EGR rate EGp as an instruction value for adjusting the amount of exhaust gas (EGR amount), which flows into the intake passage 13 via the EGR passage 20, based on engine speed NE and engine load factor KL. The EGR rate is the ratio of the EGR amount to the total amount of in-cylinder filling gas. The controller 100 calculates a target opening degree of the EGR valve 22 by which an actual EGR rate becomes equal to target EGR rate EGp based on target EGR rate EGp, intake air amount GA, and predicted exhaust pressure value EPc described below. Then, the controller 100 adjusts the amount of opening of the EGR valve 22 so that an actual opening degree of the EGR valve 22 becomes equal to the target opening degree.

The controller 100 calculates the following exhaust pressure increase rate as a value that indicates a state of an exhaust pressure that corresponds to the degree of clogging in the current filter 18. The exhaust pressure below is the pressure of exhaust gas between the filter 18 and the three-way catalyst 17.

Figure 2:
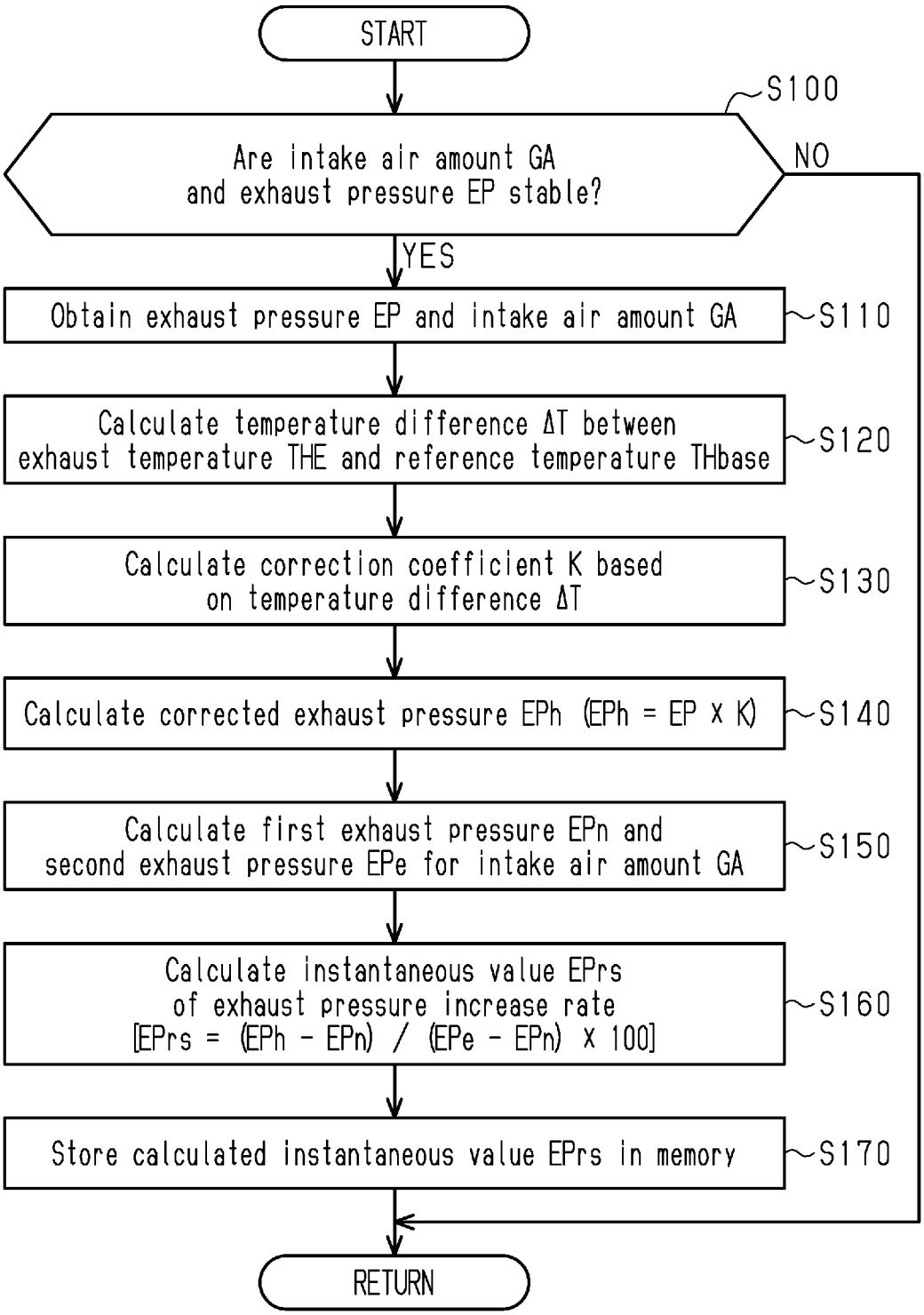
FIG. 2 is a flowchart showing the procedure of processes executed by the controller.

FIG. 2 shows the procedure of processes executed by the controller 100 to calculate the exhaust pressure increase rate. This procedure is repeatedly performed if the filter 18 is not regenerated during engine operation. In the following description, the number of each step starts with the letter "S."

When the procedure starts, the controller 100 determines whether intake air amount GA and exhaust pressure EP are stable (S100). In S100, if a state in which a fluctuation amount of intake air amount GA and exhaust pressure EP is within a specified range has continued for a specified period of time or more, the controller 100 determines that intake air amount GA and exhaust pressure EP are stable. If intake air amount GA and exhaust pressure EP are not stable (S100: NO), the controller 100 ends the procedure.

In contrast, if intake air amount GA and exhaust pressure EP are stable (S100: YES), the controller 100 obtains currently detected intake air amount GA and exhaust pressure EP (S110).

Then, the controller 100 calculates temperature difference ΔT between currently detected exhaust temperature THE and reference temperature THbase (S120). Temperature difference ΔT is a value obtained by subtracting reference temperature THbase from exhaust temperature THE. Reference temperature THbase is exhaust temperature THE obtained by measuring the relationship between the intake air amount and the exhaust pressure at the following first reference filter and the second reference filter.

Then, the controller 100 calculates correction coefficient K (K>0) based on temperature difference ΔT (S130). Correction coefficient K is a value for correcting obtained exhaust pressure EP based on temperature difference ΔT.

Figure 3:
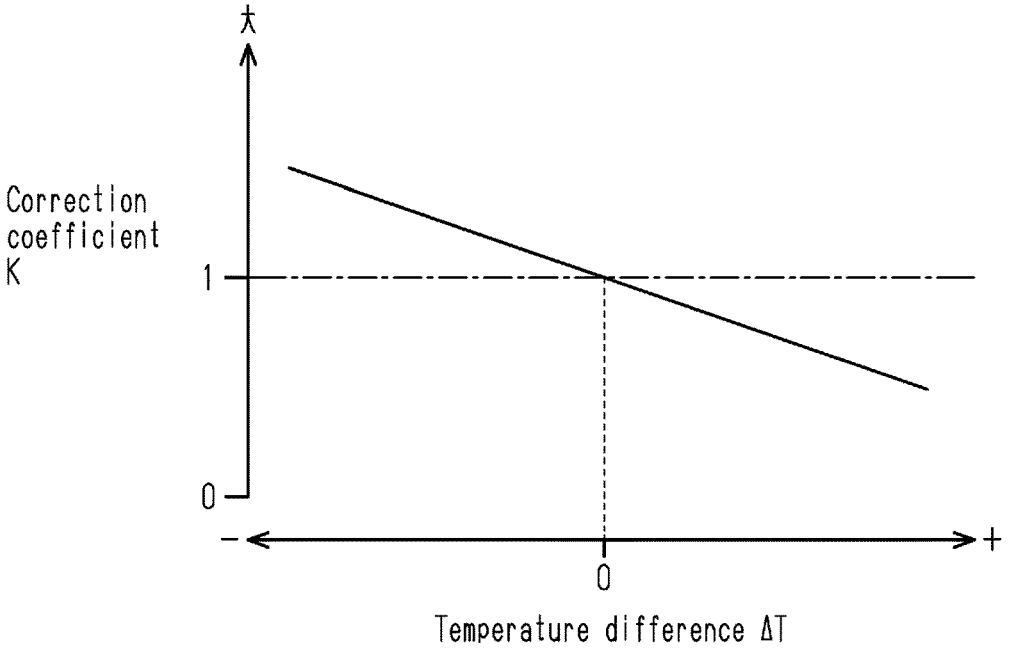
FIG. 3 is a graph showing the relationship between a temperature difference and a correction coefficient.

As shown in FIG. 3, if temperature difference ΔT is 0 (exhaust temperature THE=reference temperature THbase), 1 is set to correction coefficient K. If temperature difference ΔT is more than 0 (exhaust temperature THE>reference temperature THbase), the value of calculated correction coefficient K becomes less than 1 as the absolute value of temperature difference ΔT increases. If temperature difference ΔT is less than 0 (exhaust temperature THE<reference temperature THbase), the value of calculated correction coefficient K becomes more than 1 as the absolute value of temperature difference ΔT increases.

Then, the controller 100 calculates corrected exhaust pressure EPh by multiplying obtained exhaust pressure EP by correction coefficient K (S140). Corrected exhaust pressure EPh is a value obtained by converting exhaust pressure EP at current exhaust temperature THE into an exhaust pressure at reference temperature THbase.

Then, the controller 100 calculates first exhaust pressure EPn and second exhaust pressure EPe for obtained intake air amount GA (S150). First exhaust pressure EPn and second exhaust pressure EPe are the following values.

In the first embodiment, an unused filter 18 that has 0 deposition amount of particulate matter serves as the first reference filter. A filter 18 that has the assumed maximum deposition amount of particulate matter serves as the second reference filter. The relationship between the intake air amount and the exhaust pressure in the first reference filter is measured in advance when exhaust temperature THE is reference temperature THbase. The relationship between the measured intake air amount and exhaust pressure is stored in a memory as first reference exhaust pressure data.

Figure 4:
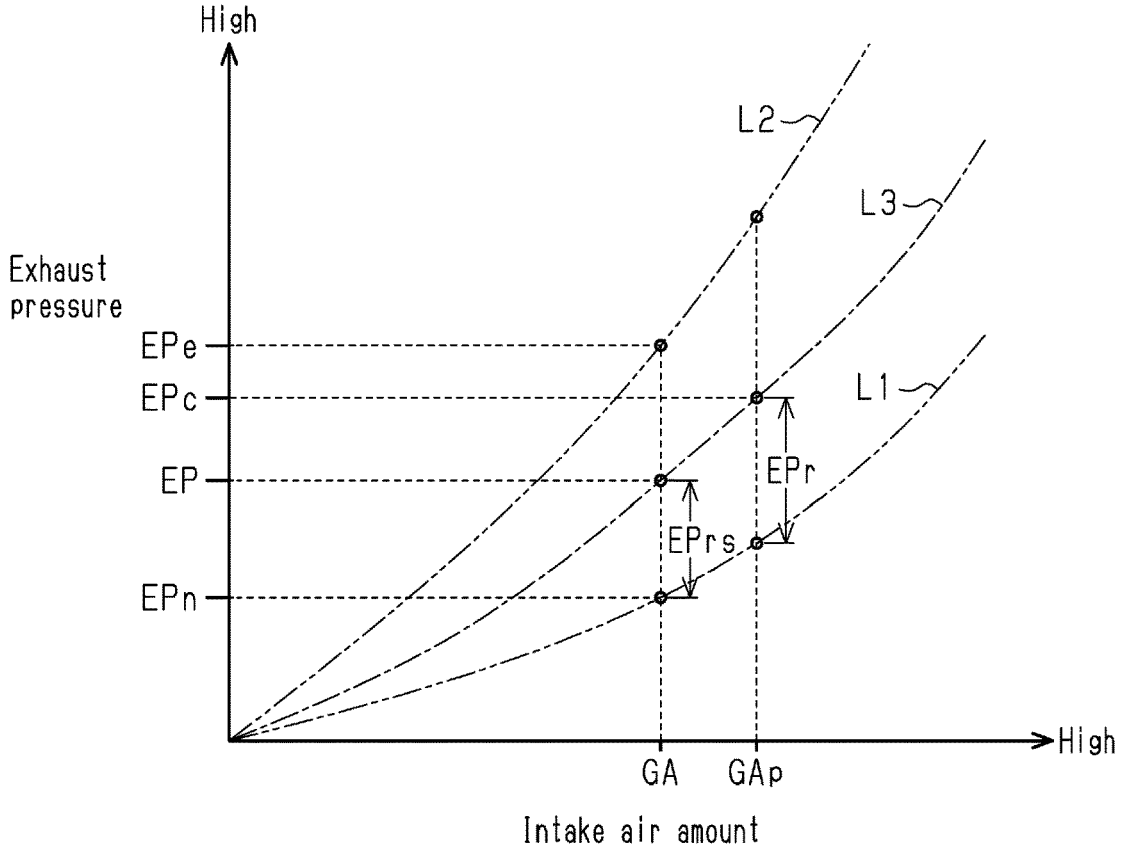
FIG. 4 is a graph showing the relationship between an exhaust pressure that is upstream of a filter and an intake air amount.

As shown by long dashed double-short dashed line L1 in FIG. 4, the first reference exhaust pressure data has a higher value of the exhaust pressure as the intake air amount increases. Likewise, the relationship between the intake air amount and the exhaust pressure in the second reference filter is measured in advance when exhaust temperature THE is reference temperature THbase. The relationship between the measured intake air amount and exhaust pressure is stored in the memory as second reference exhaust pressure data.

As shown by long dashed double-short dashed line L2 in FIG. 4, the second reference exhaust pressure data has a higher value of the exhaust pressure as the intake air amount increases. If the intake air amount is the same, the exhaust pressure in second reference exhaust pressure data is higher than the exhaust pressure in first reference exhaust pressure data.

The controller 100 refers to the first reference exhaust pressure data when calculating first exhaust pressure EPn, which is the exhaust pressure at the first reference filter, for intake air amount GA obtained in S110.

Likewise, the controller 100 refers to the second reference exhaust pressure data when calculating second exhaust pressure EPe, which is an exhaust pressure at the second reference filter, for intake air amount GA obtained in S110.

Then, the controller 100 calculates instantaneous value EPrs of exhaust pressure increase rate EPr based on following equation (1) (S160). Exhaust pressure increase rate EPr is an exhaust pressure rate that indicates the ratio of an obtained exhaust pressure to an exhaust pressure at a reference filter for an obtained intake air amount. Instantaneous value EPrs indicates an instantaneous value of exhaust pressure increase rate EPr calculated from intake air amount GA and exhaust pressure EP obtained in this process.

$$EPrs=(EPh-EPn)/(EPe-EPn)\times 100 \quad (1)$$

EPrs: instantaneous value of exhaust pressure increase rate EPr

EPh: corrected exhaust pressure

EPn: first exhaust pressure

EPe: second exhaust pressure

As will be understood in equation (1), exhaust pressure increase rate EPr indicates the rate of increase in an exhaust pressure of the current filter 18 when exhaust pressure increase rate EPr at the first reference filter is 0% and exhaust pressure increase rate EPr at the second reference filter is 100%.

Then, the controller 100 stores calculated instantaneous value EPrs in the memory (S170) and ends the procedure. The memory of the controller 100 sequentially stores calculated instantaneous values EPrs.

Figure 5:
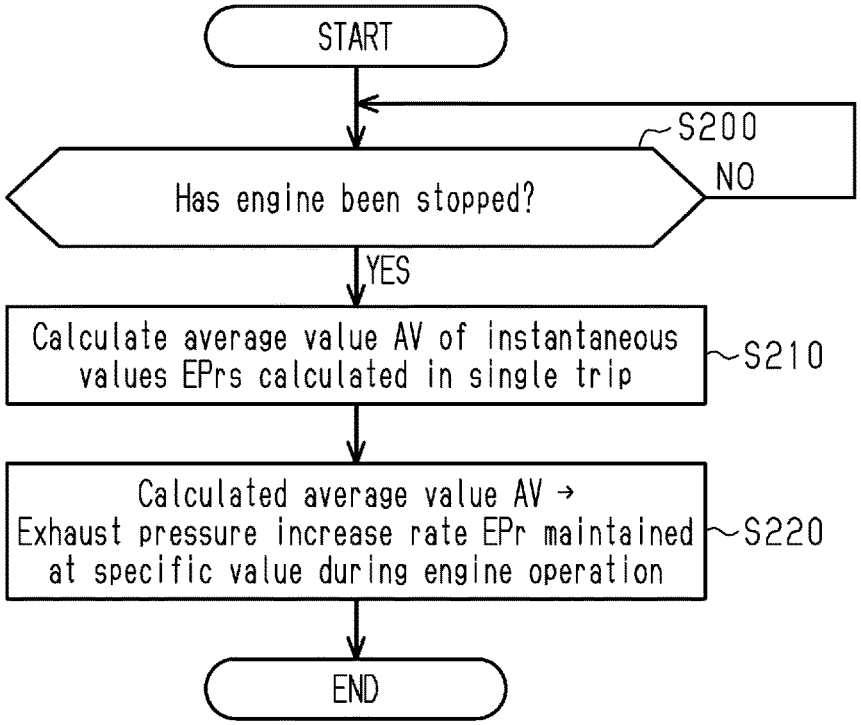
FIG. 5 is a flowchart showing the procedure of processes executed by the controller.

FIG. 5 shows the procedure of processes for setting exhaust pressure increase rate EPr maintained at a specific value during engine operation. The procedure is executed by the CPU executing programs stored in the memory of the controller 100 at predetermined intervals.

When the procedure starts, the controller 100 first determines whether the engine has been stopped (S200). In S200, if a switch that stops operation of the internal combustion engine 10 has been operated, the controller 100 determines that the engine has been stopped. The switch in this case may be an ignition switch arranged in the vehicle that includes the internal combustion engine 10. If the engine has not been stopped (S200: NO), the controller 100 repeatedly performs the process in S200 until determining that the engine has been stopped.

If the engine has been stopped (S200: YES), the controller 100 calculates average value AV of instantaneous values EPrs calculated in a single trip (S210). The controller 100 sets, to the calculated average value AV, the exhaust pressure increase rate EPr maintained at a specific value during engine operation (S220). Then, the controller 100 ends the procedure.

Set exhaust pressure increase rate EPr is used as exhaust pressure increase rate EPr maintained at a specific value during next engine operation. Exhaust pressure increase rate EPr is a value that indicates a state of an exhaust pressure that corresponds to a current degree of clogging in the filter 18. Exhaust pressure increase rate EPr is used for various types of engine control related to the exhaust pressure. When an intake air amount is predicted using an air model, for example, exhaust pressure increase rate EPr is used as a value that indicates the pressure state inside the exhaust passage 15. Predicted exhaust pressure value EPc used to calculate a target opening degree of the EGR valve 22 is calculated as described below.

The first embodiment predicts exhaust pressure EP in advance, which will be obtained when intake air amount GA achieves target intake air amount GAp that is set in accordance with an engine operation state. Thus, the controller 100 calculates predicted exhaust pressure value EPc as a predicted value of exhaust pressure EP and performs the processes shown in FIG. 6.

Figure 6:
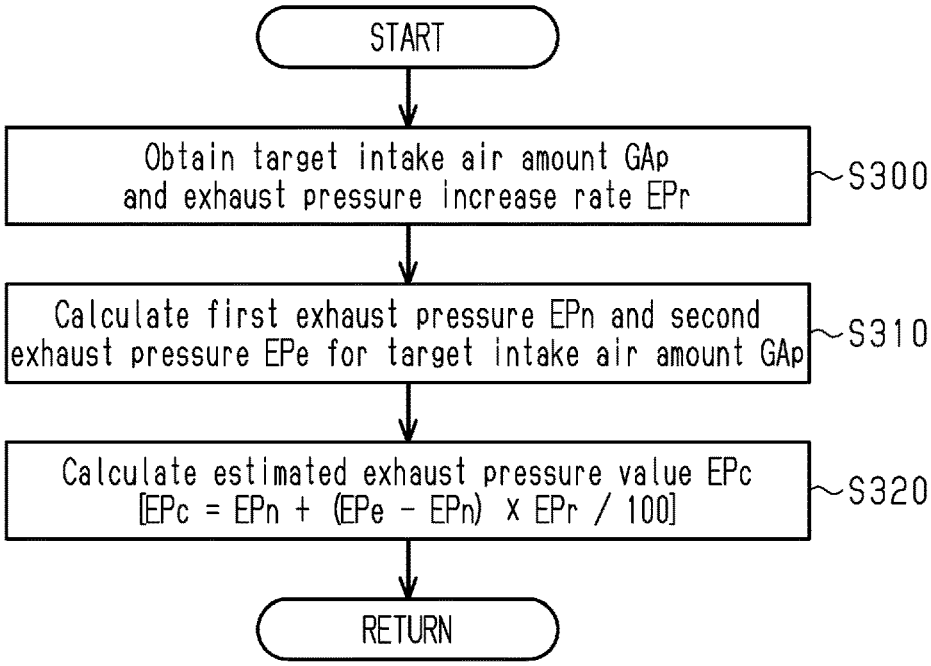
FIG. 6 is a flowchart showing the procedure of processes executed by the controller.

FIG. 6 shows the procedure of processes for calculating predicted exhaust pressure value EPc. The procedure is executed by the CPU executing programs stored in the memory of the controller 100. The processes are performed to calculate a target opening degree of the EGR valve 22.

When the procedure starts, the controller 100 first obtains currently set target intake air amount GAp and exhaust pressure increase rate EPr (S300). Then, the controller 100 calculates first exhaust pressure EPn and second exhaust pressure EPe for obtained target intake air amount GAp (S310). In S310, the controller 100 refers to the first reference exhaust pressure data when calculating first exhaust pressure EPn, which is an exhaust pressure at the first reference filter, for obtained target intake air amount GAp.

Likewise, the controller 100 refers to the second reference exhaust pressure data when calculating second exhaust pressure EPe, which is an exhaust pressure at the second reference filter, for obtained target intake air amount GAp.

Then, the controller 100 calculates predicted exhaust pressure value EPc based on following equation (2) (S320).

$$EPc=EPn+(EPe-EPn)\times EPr/100 \quad (2)$$

EPc: predicted exhaust pressure value

EPn: first exhaust pressure

EPe: second exhaust pressure

EPr: exhaust pressure increase rate

Predicted exhaust pressure value EPc is calculated from equation (2). As shown in FIG. 4, an exhaust pressure (predicted exhaust pressure value EPc) that will be obtained when intake air amount GA achieves target intake air amount GAp is calculated in advance based on exhaust pressure increase rate EPr at the current filter 18 indicated by alternate long and short dash line L3.

The first embodiment achieves the following advantages.

(1) The state of the exhaust pressure that corresponds to the degree of clogging in the current filter 18 affects exhaust pressure increase rate EPr based on the first reference filter and the second reference filter. Exhaust pressure increase rate EPr is maintained at a specific value during engine operation so that exhaust pressure increase rate EPr, which is a value that indicates a state of an exhaust pressure, is stable during engine operation. Thus, engine control based on the value that indicates the state of the exhaust pressure is stable.

(2) Even if the intake air amount is the same, exhaust pressure EP increases as the temperature of the exhaust gas rises, so that the value of exhaust pressure increase rate EPr will increase. In this respect, the first embodiment corrects calculated exhaust pressure increase rate EPr to decrease as the temperature of exhaust gas flowing into the filter 18 rises. Specifically, as the value of temperature difference ΔT increases and exhaust temperature THE is higher than reference temperature THbase, correction coefficient K is reduced to correct exhaust pressure EP to decrease. When corrected exhaust pressure EPh is lower, the value of (EPh−EPn) in equation (1) becomes smaller so that the value of calculated instantaneous value EPrs will be reduced. This reduces exhaust pressure increase rate EPr, which is average value AV of plural instantaneous values EPrs. In this manner, exhaust pressure increase rate EPr is corrected to decrease as exhaust temperature THE rises so that error of exhaust pressure increase rate EPr caused by a difference of exhaust temperatures will be reduced. With this structure, the exhaust pressure rate may be directly corrected based on the temperature of exhaust gas. Alternatively, the exhaust pressure rate may be indirectly corrected by correcting an obtained exhaust pressure based (3) In the calculation process shown in FIG. 2, instantaneous value EPrs of exhaust pressure increase rate EPr is calculated each time exhaust pressure EP and intake air amount GA are obtained. During engine operation, the amount of particulate matter deposited in filter 18 hardly increases rapidly. Thus, an average value of plural instantaneous values EPrs calculated during engine operation will be a value approximate to a true value that indicates the state of an exhaust pressure of the current filter 18. Thus, in the first embodiment, a value of exhaust pressure increase rate EPr maintained at a specific value during engine operation is set to average value AV of instantaneous values EPrs. This allows setting of exhaust pressure increase rate EPr maintained at a specific value during engine operation to a suitable value.

(4) The processes shown in FIG. 6 are performed to predict exhaust pressure EP when intake air amount GA achieves target intake air amount GAp. Since an exhaust pressure when the intake air amount achieves the target value can be predicted, the predicted value can be used for engine control. For example, a target opening degree of the EGR valve 22 is set in consideration of a value of predicted exhaust pressure EP (predicted exhaust pressure value EPc). This restricts deviation between actual EGR rate and target EGR rate EGp when intake air amount GA achieves target intake air amount GAp, thereby improving the accuracy of control of the EGR rate.

Second Embodiment

The controller 100 for the internal combustion engine 10 according to a second embodiment will now be described with reference to FIGS. 7 to 9.

In the first embodiment, exhaust pressure increase rate EPr is maintained at a specific value during engine operation. In contrast, the second embodiment performs a tracking process of changing exhaust pressure increase rate EPr that is set during engine operation in accordance with a change in obtained exhaust pressure EP if exhaust pressure increase rate EPr, which is maintained at a specific value during engine operation, deviates from an actual state of the exhaust pressure.

Figure 7:
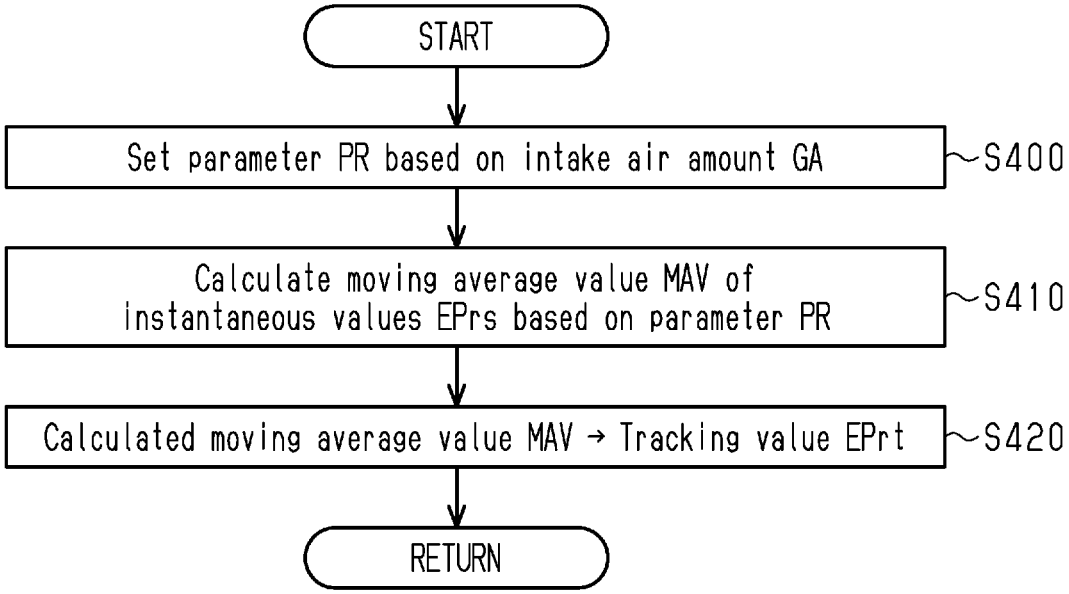
FIG. 7 is a flowchart showing the procedure of processes executed by a controller according to a second embodiment of the present disclosure.

FIG. 7 is a flowchart showing the procedure of processes executed by the controller 100. This procedure is repeatedly performed if instantaneous value EPrs shown in FIG. 2 is calculated. When the procedure starts, the controller 100 sets parameter PR based on intake air amount GA (S400). Parameter PR is used to calculate moving average value MAV of instantaneous values EPrs.

Figure 8:
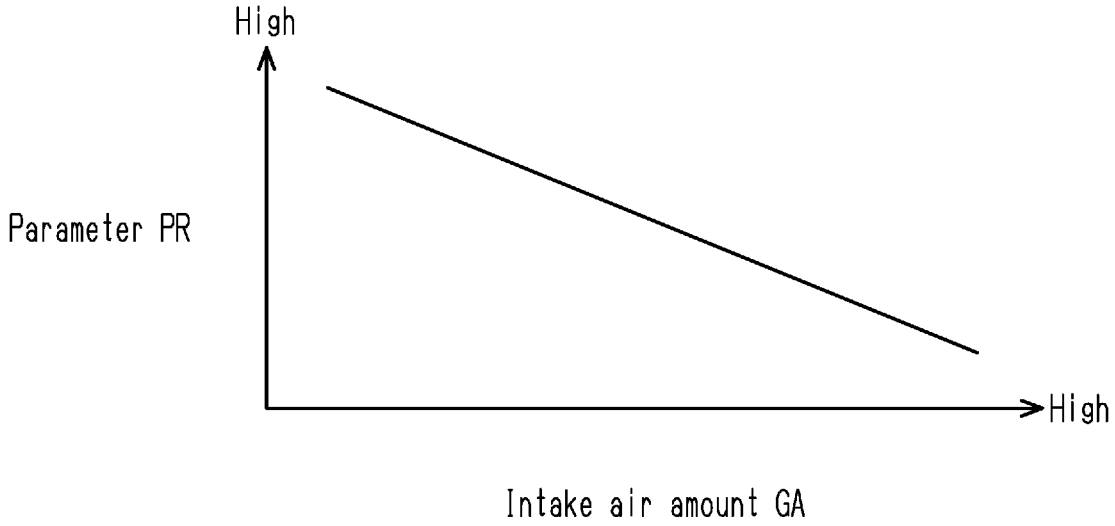
FIG. 8 is a graph showing the relationship between an intake air amount and a set parameter.

As shown in FIG. 8, parameter PR is variably set to decrease as intake air amount GA increases. Then, the controller 100 calculates moving average value MAV of instantaneous values EPrs based on parameter PR set in S400 (S410).

Then, the controller 100 sets, to calculated moving average value MAV, tracking value EPrt of exhaust pressure increase rate EPr (S420) and ends the procedure. In this manner, if instantaneous value EPrs is calculated during engine operation, the controller 100 also calculates tracking value EPrt.

The procedure of processes for setting a fixed value or a tracking value to exhaust pressure increase rate EPr, which is set during engine operation, will now be described with reference to FIG. 9. This procedure is repeatedly executed by the controller 100 during engine operation.

The fixed value is a value of the exhaust pressure increase rate maintained at a specific value during engine operation. The fixed value corresponds to average value AV. The tracking value is a value of the exhaust pressure increase rate adjusted in accordance with a change in exhaust pressure EP obtained during engine operation. The tracking value corresponds to tracking value EPrt. In the series of processes shown in FIG. 2, when the value of obtained exhaust pressure EP is changed, the value of calculated instantaneous value EPrs is also changed. Thus, when the value of obtained exhaust pressure EP is changed, tracking value EPrt is also changed. A mode by which exhaust pressure increase rate EPr, which is set during engine operation, is a fixed value is referred to as a fixed mode. A mode by which exhaust pressure increase rate EPr, which is set during engine operation, is a tracking value is referred to as a tracking mode.

When the procedure starts, the controller 100 first determines whether the current mode is the fixed mode (S500). As described in first embodiment, when the engine starts, exhaust pressure increase rate EPr is fixed to average value AV. Thus, when the procedure is performed first after the engine has started, the controller 100 determines that the current mode is the fixed mode.

In the case of the fixed mode (S500: YES), the controller 100 determines whether a shifting condition for the tracking mode is met (S510). The shifting condition for the tracking mode is met if exhaust pressure increase rate EPr maintained at a specific value, that is, exhaust pressure increase rate EPr, which is a fixed value, deviates from an actual state of the exhaust pressure. In the second embodiment, if at least one of the following conditions (A) to (D), for example, is met, the controller 100 determines that the shifting condition for the tracking mode is met.

Condition (A): Forcible regeneration process was performed on the filter 18 in a maintenance factory. This condition is set for the following reason. If a forcible regeneration process is performed on the filter 18, the PM deposition amount of the filter 18 is greatly reduced and the exhaust pressure decreases. Thus, exhaust pressure increase rate EPr, which is currently a fixed value, deviates from an actual state of the exhaust pressure.

Condition (B): Changed amount Psha of PM deposition amount Ps is greater than or equal to preset determination value A. Changed amount Psha is the difference between PM deposition amount Ps at the time when exhaust pressure increase rate EPr, for example, was previously updated and current PM deposition amount Ps. This condition is set for the following reason. If changed amount Psha is greater than or equal to preset determination value A, the degree of clogging in the filter 18 is changed and exhaust pressure increase rate EPr, which is currently a fixed value, deviates from an actual state of the exhaust pressure. A value suitable for the determination is set to determination value A.

Condition (C): Absolute value AB of difference ($AB=|EPr-EPrt|$) between exhaust pressure increase rate EPr for which a fixed value is currently set and currently calculated tracking value EPrt is greater than or equal to preset determination value B. This condition is set for the following reason. If the filter 18, for example, is replaced, a process of resetting the value of exhaust pressure increase rate EPr is performed. If the reset process is not performed, absolute value AB increases. Further, an erroneous value of tracking value EPrt or exhaust pressure increase rate EPr caused by an unexpected error also increases absolute value AB. That is, when absolute value AB increases, exhaust pressure increase rate EPr, which is currently a fixed value, deviates from an actual state of the exhaust pressure. A value suitable for the determination is set to determination value B.

Condition (D): Regeneration control has been performed on the filter 18 for specified period of time or more. This condition is set for the following reason. If a regeneration control has been performed on the filter 18 for a long period of time, the PM deposition amount of the filter 18 is greatly reduced and the exhaust pressure decreases. Thus, exhaust pressure increase rate EPr, which is currently a fixed value, deviates from an actual state of the exhaust pressure. A value suitable for the determination is set to the specified period of time.

If the shifting condition for the tracking mode is met (S510: YES), the controller 100 starts the tracking mode (S520). The tracking mode performs a tracking process of setting exhaust pressure increase rate EPr during engine operation to currently calculated tracking value EPrt. Then, the controller 100 ends the procedure.

If the shifting condition for the tracking mode is not met (S510: NO), the controller 100 performs a process in S530 that continues the fixed mode so that the controller 100 ends the procedure while maintaining exhaust pressure increase rate EPr at average value AV during engine operation.

If the current mode is not the fixed mode (S500: NO), specifically, if the current mode is the tracking mode, the controller 100 determines whether shifting conditions for the fixed mode are met (S540). If condition (E) and condition (F), for example, below are both met, the controller 100 determines that the shifting conditions for the fixed mode are met.

Condition (E): Changed amount Pshb of PM deposition amount Ps is less than or equal to preset determination value C. Changed amount Pshb is the difference between PM deposition amount Ps immediately after a regeneration process of the filter 18 is stopped and the current PM deposition amount Ps. To determination value C, a value that suitably allows for determination that a changed amount of PM deposition amount Ps is small is set. Specifically, when changed amount Pshb is lower than or equal to preset determination value C, the change in currently calculated instantaneous value EPrs is small. Thus, even if exhaust pressure increase rate EPr is set to average value AV of instantaneous values EPrs as a fixed value, an actual state of the exhaust pressure is applied to exhaust pressure increase rate EPr.

Condition (F): The number of calculated instantaneous values EPrs is greater than or equal to determination value D. When exhaust pressure increase rate EPr is set to average value AV of instantaneous values EPrs as a fixed value, a sufficient number of instantaneous values EPrs should be calculated so that a state of an exhaust pressure that corresponds to a degree of clogging in the filter 18 is applied to average value AV. A value suitable for determination of such a number is set to determination value D.

If the shifting conditions for the fixed mode are met (S540: YES), the controller 100 starts the fixed mode (S550). The fixed mode performs a process of calculating average value AV of instantaneous values EPrs, the number of which is determined to be greater than or equal to determination value D, and setting, to average value AV, a fixed value of exhaust pressure increase rate EPr maintained at a specific value during engine operation. Then, the controller 100 ends the procedure.

If the shifting conditions for the fixed mode are not met (S540: NO), the controller 100 performs a process in S560 that continues the tracking mode so that the controller 100 sets exhaust pressure increase rate EPr during engine operation to tracking value EPrt and ends the procedure.

The second embodiment has the following advantage in addition to the advantages of the first embodiment.

(5) If the amount of particulate matter deposited in the filter 18 is rapidly reduced when the filter 18 is regenerated, for example, exhaust pressure increase rate EPr fixed at a specific value deviates from an actual state of the exhaust pressure that corresponds to a degree of clogging in the filter 18. Thus, in the second embodiment, if such a deviation occurs, the controller 100 starts the tracking mode to perform the tracking process that changes exhaust pressure increase rate EPr in accordance with a change in obtained exhaust pressure EP. This prevents exhaust pressure increase rate EPr that is set during engine operation from deviating from an actual state of the exhaust pressure.

(6) In the tracking process, exhaust pressure increase rate EPr that is set during engine operation is set to moving average value MAV of instantaneous values EPrs, which are calculated each time exhaust pressure EP and intake air amount GA are obtained. This changes exhaust pressure increase rate EPr that is set during engine operation in accordance with a change in exhaust pressure EP while reducing variations of obtained exhaust pressure EP.

(7) When the intake air amount increases, exhaust pressure EP is higher than when the intake air amount decreases. Thus, variations of exhaust pressure EP do not have a substantial influence on instantaneous value EPrs of the exhaust pressure increase rate. Thus, in the second embodiment, parameter PR of moving average value MAV decreases as intake air amount GA increases. In this manner, when intake air amount GA increases and variations of exhaust pressure EP do not have a substantial influence on instantaneous value EPrs of the exhaust pressure increase rate, parameter PR of moving average value MAV is reduced to improve tracking of moving average value MAV relative to a change in exhaust pressure EP.

Third Embodiment

The controller 100 for the internal combustion engine 10 according to a third embodiment will now be described with reference to FIG. 10.

Figure 9:
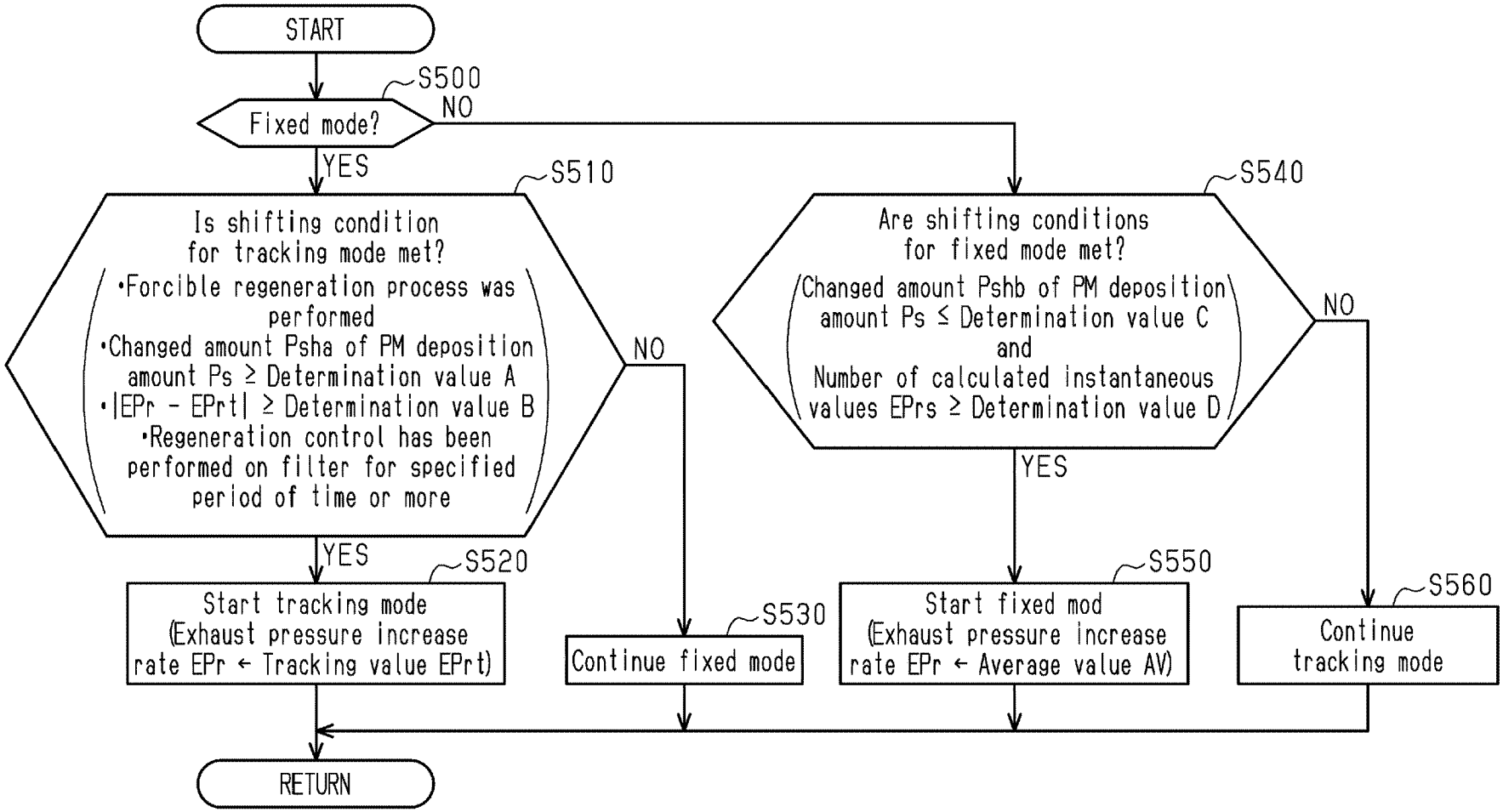
FIG. 9 is a flowchart showing the procedure of processes executed by the controller.
Figure 10:
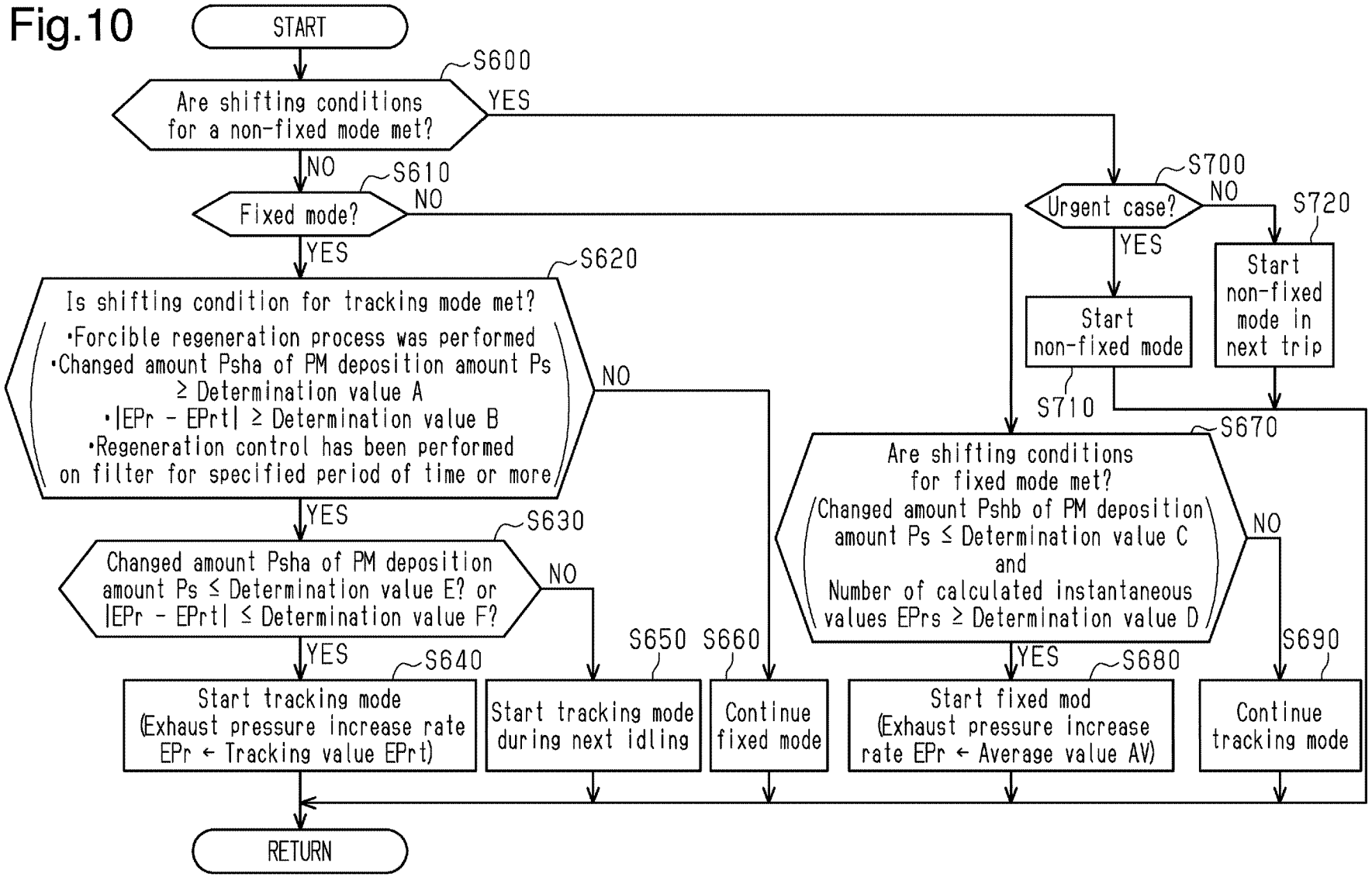
FIG. 10 is a flowchart showing the procedure of processes executed by a controller according to a third embodiment of the present disclosure.

The controller 100 according to the third embodiment performs the process shown in FIG. 10 obtained by partially modifying the process in FIG. 9 described in the second embodiment. The description of the third embodiment will focus on the difference from the process shown in FIG. 9.

FIG. 10 shows the procedure of processes executed by the controller 100 according to the third embodiment. The procedure is repeatedly performed during engine operation. When the procedure starts, the controller 100 first determines whether shifting conditions for a non-fixed mode are met (S600). The non-fixed mode performs a process that sets a value of exhaust pressure increase rate EPr to a value indicating that exhaust pressure increase rate EPr is not set if the value of exhaust pressure increase rate EPr is unclear due to a failure of the pressure sensor 50 or the like. The shifting conditions for the non-fixed mode include various conditions such as when an anomaly of the pressure sensor 50 is detected and when the value of exhaust pressure increase rate EPr is an anomalous value outside a preset range.

If the shifting conditions for the non-fixed mode are met (S600: YES), the controller 100 determines presence or absence of the urgency of shifting to the non-fixed mode (S700). An anomaly that hiders engine operation such as a failure of the pressure sensor 50 and requires a prompt fail safe process is determined as urgent. An anomaly that does not significantly hinder engine operation is determined as less urgent.

In the urgent case (S700: YES), the controller 100 immediately starts the non-fixed mode (S710) and ends the procedure. When the non-fixed mode starts, a value indicating that exhaust pressure increase rate EPr is not set is set to the value of exhaust pressure increase rate EPr. When the value of the non-fixed mode is set to the value of exhaust pressure increase rate EPr, fail safe processes are performed in various types of engine control that use exhaust pressure increase rate EPr.

In the less urgent case (S700: NO), the controller 100 sets a flag or the like to start the non-fixed mode in the next trip (S720) and ends the procedure.

If the shifting conditions for the non-fixed mode are not met (S600: NO), the controller 100 determines whether the current mode is the fixed mode (S610). The process in S610 is the same as the process in S500.

If the current mode is the fixed mode (S610: YES), the controller 100 determines whether the shifting condition for the tracking mode is met (S620). The process in S620 is the same as the process in S510.

If the shifting condition for the tracking mode is met (S620: YES), the controller 100 determines whether at least one of condition (G) or condition (H) below is met (S630).

Condition (G): Changed amount Psha of PM deposition amount Ps is less than or equal to preset determination value E. Changed amount Psha is the difference between PM deposition amount Ps at the time when exhaust pressure increase rate EPr, for example, is previously updated and current PM deposition amount Ps in the same manner as condition (B). Determination value E is greater than or equal to determination value A and set in accordance with the description below. Specifically, if changed amount Psha is small, a degree of clogging in the filter 18 is not greatly changed. Thus, even if exhaust pressure increase rate EPr for which a fixed value is currently set is changed to tracking value EPrt, exhaust pressure increase rate EPr is not significantly changed. Thus, even if exhaust pressure increase rate EPr is shifted from a fixed value to a tracking value during engine operation, the shifting of exhaust pressure increase rate EPr does not adversely affect engine control. The magnitude of determination value E is set to suitably allow for determination of changed amount Psha so that when changed amount Psha is less than or equal to determination value E, even if exhaust pressure increase rate EPr is shifted from a fixed value to a tracking value during engine operation, the shifting of exhaust pressure increase rate EPr does not adversely affect engine control.

Condition (H): Absolute value AB of difference (AB=|EPr−EPrt|) between exhaust pressure increase rate EPr for which a fixed value is currently set and currently calculated tracking value EPrt is less than or equal to preset determination value F Determination value F is greater than or equal to determination value B and set in accordance with the description below. When absolute value AB is small, even if exhaust pressure increase rate EPr for which a fixed value is currently set is changed to tracking value EPrt, exhaust pressure increase rate EPr is not significantly changed. Thus, even if exhaust pressure increase rate EPr is shifted from the fixed value to a tracking value during engine operation, the shifting of exhaust pressure increase rate EPr does not adversely affect engine control. The magnitude of determination value F is set to suitably allow for determination of absolute value AB so that when absolute value AB is less than or equal to determination value F, even if exhaust pressure increase rate EPr is shifted from a fixed value to a tracking value during engine operation, the shifting of exhaust pressure increase rate EPr does not adversely affect engine control.

If at least one of condition (G) or condition (H) is met (S630: YES), the controller 100 performs the process in S640 and starts the tracking mode. The process in S640 is the same as the process in S520. Then, the controller 100 ends the procedure.

If neither condition (G) nor condition (H) are met (S630: NO), the controller 100 sets a flag or the like to start the tracking mode during next idling (S650) and ends the procedure.

If the shifting condition for the tracking mode is not met (S620: NO), the controller 100 performs a process in S660 and continues the fixed mode. The process in S660 is the same as the process in S530. Then, the controller 100 ends the procedure.

If the current mode is not the fixed mode (S610: NO), namely, if the current mode is the tracking mode, the controller 100 determines whether the shifting conditions for the fixed mode are met (S670). The process in S670 is the same as the process in S540.

If the shifting conditions for the fixed mode are met (S670: YES), the controller 100 starts the fixed mode (S680). The process in S680 is the same as the process in S550. Then, the controller 100 ends the procedure.

If the shifting conditions for the fixed mode are not met (S670: NO), the controller 100 performs a process in S690 and continues the tracking mode. The process in S690 is the same as the process in S560. Then, the controller 100 ends the procedure.

The third embodiment has the following advantage in addition to the advantages of the second embodiment.

(8) When exhaust pressure increase rate EPr is used for engine control, if average value AV for which a fixed value is set is shifted to tracking value EPrt during engine operation so that exhaust pressure increase rate EPr that is set during engine operation is greatly changed, this adversely affects engine control. In other words, a small changed amount of exhaust pressure increase rate EPr does not have a substantial influence on engine control even if average value AV for which a fixed value is set is shifted to tracking value EPrt.

Thus, in the third embodiment, if the shifting condition for the tracking mode is met in the process in S620 to shift exhaust pressure increase rate EPr that is set during engine operation from average value AV for which a fixed value is set to tracking value EPrt, the controller 100 performs a process in S630 that determines whether at least condition (G) or condition (H) is met. If at least one of condition (G) or condition (H) is met (S630: YES), specifically, if exhaust pressure increase rate EPr is not greatly changed even if the value of exhaust pressure increase rate EPr is shifted from a fixed value to a tracking value, the controller 100 performs the process in S640 to immediately shift from the fixed value to the tracking value. This restricts an influence on engine control caused by the shift from the fixed value to the tracking value.

If neither condition (G) nor condition (H) are met when shifting from the fixed value to the tracking value (S630: NO), specifically, if exhaust pressure increase rate EPr is predicted to be greatly changed when the value of exhaust pressure increase rate EPr is shifted from the fixed value to the tracking value, the controller 100 shifts from the fixed value to the tracking value while engine operation is idling. During idling, engine operation is stable and does not have a substantial influence on engine control even if exhaust pressure increase rate EPr is greatly changed. This restricts an influence on engine control caused by the shift from the fixed value to the tracking value if exhaust pressure increase rate EPr is greatly changed by the shift from the fixed value to the tracking value.

The above described embodiments may be modified as follows. The above-described embodiments and the following modifications can be combined as long as the combined modifications remain technically consistent with each other.

For a filter in which a deposition amount of particulate matter is a specified amount, the unused filter 18 that has 0 deposition amount of particulate matter serves as the first reference filter. The filter 18 that has the assumed maximum deposition amount of particulate matter serves as the second reference filter. Further, a value that indicates a rate of increase in an exhaust pressure of the current filter 18 is exhaust pressure increase rate EPr when exhaust pressure increase rate EPr in the first reference filter is 0% and exhaust pressure increase rate EPr in the second reference filter is 100%. Instead, setting of the reference filters may be changed.

For a filter in which a deposition amount of particulate matter is a specified amount, the unused filter 18 that has 0 deposition amount of particulate matter may serve as the best reference filter, for example. The ratio of an exhaust pressure in the current filter 18 to an exhaust pressure in the best reference filter for the same intake air amount GA may be calculated as an exhaust pressure rate that corresponds to exhaust pressure increase rate EPr.

A filter 18 that has the assumed maximum deposition amount of particulate matter may serve as the worst reference filter. The ratio of an exhaust pressure in the current filter 18 to an exhaust pressure in the worst reference filter for the same intake air amount GA may be calculated as an exhaust pressure rate that corresponds to exhaust pressure increase rate EPr.

Exhaust pressure EP is corrected with correction coefficient K. Instead, instantaneous value EPrs and exhaust pressure increase rate EPr may be corrected with coefficients similar to correction coefficient K. This corrects calculated exhaust pressure increase rate EPr to decrease as the temperature of exhaust gas flowing into the filter 18 rises.

Correction coefficient K is calculated to decrease calculated exhaust pressure increase rate EPr as the temperature of exhaust gas flowing into the filter 18 rises. Instead, calculated exhaust pressure increase rate EPr may be corrected in other manners such as by referring to a map that presets the relationship between temperature difference ΔT and corrected exhaust pressure EPh.

The process of correcting calculated exhaust pressure increase rate EPr in accordance with the temperature of exhaust gas flowing into the filter 18 may be omitted. Specifically, the calculation process of correction coefficient K or the calculation process of corrected exhaust pressure EPh may be omitted. In this case, the advantages other than (2) above can still be obtained.

Parameter PR of moving average value MAV is changed based on intake air amount GA. Instead, parameter PR may be a fixed value. In this case, the advantages other than (7) above can still be obtained.

The procedure may start from S610 by omitting the processes in S600, S700, S710, and S720 shown in FIG. 10.

Exhaust pressure EP is detected by the pressure sensor 50. Instead, exhaust pressure EP may be estimated based on an engine operation state.

The controller 100 is not limited to a device that includes a CPU and a memory and executes software processing. For example, a dedicated hardware circuit (such as ASIC) may be provided that executes at least part of the software processing executed in each of the above embodiments. That is, the controller 100 may be modified to have any one of the following configurations (a) to (c). (a) A configuration including a processor that executes all of the above-described processes according to programs and a program storage device such as a memory that stores the programs. (b) A configuration including a processor and a program storage device that executes part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits or a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for an internal combustion engine, wherein the internal combustion engine includes a filter that is arranged in an exhaust passage and collects particulate matter from exhaust gas, and an intake flow rate sensor that detects an intake air amount drawn into a cylinder, the filter in which a deposition amount of particulate matter is a specified amount is referred to as a reference filter, and the controller is configured to perform:

a process of obtaining an exhaust pressure upstream of the filter inside the exhaust passage and the intake air amount detected by the intake flow rate sensor;

a calculation process of calculating an exhaust pressure rate that indicates a ratio of the obtained exhaust pressure to an exhaust pressure at the reference filter for the obtained intake air amount; and a setting process of setting the exhaust pressure rate that is maintained at a specific value during engine operation, wherein the exhaust pressure rate is used for engine control related to the exhaust pressure, wherein the controller is configured to set, in the setting process, the exhaust pressure rate, which is maintained at the specific value, to an average value of a plurality of exhaust pressure rates that are calculated in the calculation process each time the exhaust pressure and the intake air amount are obtained during the engine operation.

2. The controller for an internal combustion engine according to claim 1, wherein the controller is configured to correct, in the calculation process, the calculated exhaust pressure rate so as to decrease as a temperature of exhaust gas flowing into the filter rises.

3. The controller for an internal combustion engine according to claim 1, wherein the controller is configured to perform, when the exhaust pressure rate, which is maintained at the specific value, deviates from a state of the exhaust pressure, a tracking process of changing the exhaust pressure rate that is set during engine operation in accordance with a change in the obtained exhaust pressure.

4. The controller for an internal combustion engine according to claim 3, wherein a value of the exhaust pressure rate that is maintained at the specific value is referred to as a fixed value, a value of the exhaust pressure rate that is changed in the tracking process is referred to as a tracking value, a condition in which a changed amount of the deposition amount is less than or equal to a preset value is defined as a first condition, a condition in which a difference between the fixed value and the tracking value is less than or equal to a preset value is defined as a second condition, and the controller is configured to:

immediately perform a shift from the fixed value to the tracking value if at least one of the first condition or the second condition is met when a value of the exhaust pressure rate, which is set during engine operation, is shifted from the fixed value to the tracking value, and perform the shift from the fixed value to the tracking value while engine operation is idling if neither the first condition nor the second condition are met.

5. The controller for an internal combustion engine according to claim 1, wherein the controller is configured to perform:

a process of obtaining a target value of the intake air amount; and a process of calculating an exhaust pressure when the intake air amount achieves the target value based on an exhaust pressure at the reference filter for the obtained target value and the exhaust pressure rate.

6. A controller for an internal combustion engine, wherein the internal combustion engine includes a filter that is arranged in an exhaust passage and collects particulate matter from exhaust gas, and an intake flow rate sensor that detects an intake air amount drawn into a cylinder, the filter in which a deposition amount of particulate matter is a specified amount is referred to as a reference filter, and the controller comprises a circuit that is configured to perform:

a process of obtaining an exhaust pressure upstream of the filter inside the exhaust passage and the intake air amount detected by the intake flow rate sensor;

a calculation process of calculating an exhaust pressure rate that indicates a ratio of the obtained exhaust pressure to an exhaust pressure at the reference filter for the obtained intake air amount; and a setting process of setting the exhaust pressure rate that is maintained at a specific value during engine operation, wherein the exhaust pressure rate is used for engine control related to the exhaust pressure, wherein the circuit is configured to set, in the setting process, the exhaust pressure rate, which is maintained at the specific value, to an average value of a plurality of exhaust pressure rates that are calculated in the calculation process each time the exhaust pressure and the intake air amount are obtained during the engine operation.

7. A control method for an internal combustion engine, wherein the internal combustion engine includes a filter that is arranged in an exhaust passage and collects particulate matter from exhaust gas, and an intake flow rate sensor that detects an intake air amount drawn into a cylinder, the filter in which a deposition amount of particulate matter is a specified amount is referred to as a reference filter, and the control method comprises:

obtaining an exhaust pressure upstream of the filter inside the exhaust passage and the intake air amount detected by the intake flow rate sensor;

calculating an exhaust pressure rate that indicates a ratio of the obtained exhaust pressure to an exhaust pressure at the reference filter for the obtained intake air amount; and setting the exhaust pressure rate that is maintained at a specific value during engine operation, wherein the exhaust pressure rate is used for engine control related to the exhaust pressure, wherein setting the exhaust pressure rate includes setting the exhaust pressure rate, which is maintained at the specific value, to an average value of a plurality of exhaust pressure rates that are calculated each time the exhaust pressure and the intake air amount are obtained during the engine operation.

* * * * *